US006076515A

United States Patent [19]

Smith

[11] Patent Number: 6,076,515

[45] Date of Patent: Jun. 20, 2000

[54] PORTABLE, SELF-CONTAINED HEATING APPARATUS

[76] Inventor: Wayne Smith, 583 E. Aloha, Sandy, Utah 84070

[21] Appl. No.: 09/247,535

[22] Filed: Feb. 10, 1999

[51] Int. Cl.[7] ..... F24C 1/16; F23D 3/16; C10L 11/00

[52] U.S. Cl. ..... 126/9 A; 126/59.5; 126/275 R; 126/146; 431/289; 431/291; 44/532; 44/520

[58] Field of Search ..... 126/9 A, 59.5, 126/43, 25 R, 275 R, 146, 163 R; 431/288, 289, 290, 291; 44/540, 519, 520, 532, 533

[56] References Cited

U.S. PATENT DOCUMENTS

| | | | |
|---|---|---|---|
| 829,072 | 8/1906 | Hill | 44/522 |
| 987,921 | 3/1911 | Sendlein | 44/540 |
| 1,919,407 | 7/1933 | Wood | 126/15 R |
| 2,107,054 | 2/1938 | Haymond | 44/533 |
| 2,488,014 | 11/1949 | Higman | 126/9 A |
| 2,671,330 | 3/1954 | Ajello | 431/291 |
| 2,843,105 | 7/1958 | Badish | 126/25 R |
| 3,248,907 | 5/1966 | Watson | 431/291 |
| 3,262,445 | 7/1966 | Stults et al. | 126/43 |
| 3,367,758 | 2/1968 | Ambrose et al. | 431/288 |
| 3,502,068 | 3/1970 | Henson | 126/43 |
| 3,759,675 | 9/1973 | Lazarus et al. | 126/59.5 |
| 3,769,957 | 11/1973 | Ozaki | 126/9 A |
| 4,532,913 | 8/1985 | Murase | 126/146 |
| 4,725,286 | 2/1988 | Brame | 44/533 |
| 5,230,325 | 7/1993 | Williams | 126/25 B |
| 5,469,835 | 11/1995 | Stephen et al. | 126/9 A |
| 5,743,248 | 4/1998 | Jansen, Jr. | 126/25 R |

*Primary Examiner*—Ira S. Lazarus
*Assistant Examiner*—Josiah C Cocks
*Attorney, Agent, or Firm*—Thorpe, North & Western, LLP

[57] ABSTRACT

A portable, self-contained heating apparatus has a container filled with a plurality of vertically oriented, elongated combustible objects defining a plurality of passages for allowing the flow of air. The container has a first plurality of vent openings formed near the lower end of the container, and a second plurality of vent openings formed near the upper end of the container. The vent openings allow air into the container. A wax material substantially coats the elongated combustible objects without filling all of the passages or the container. First and second bands are movably disposed on the container and move between a first location over the vent openings, and a second location away from the openings. The bands control the flow of air into the container, and thus the rate at which the elongated combustible objects burn.

20 Claims, 5 Drawing Sheets

PORTABLE, SELF-CONTAINED HEATING APPARATUS

BACKGROUND OF THE INVENTION

1. Field of the Invention

The present invention relates to a portable, self-contained heating apparatus. More particularly, the present invention relates to a container filled with a plurality of vertically oriented elongated combustible objects defining a plurality of passages therebetween, and having a plurality of vent openings in a wall of the container with means for selectively opening and closing the openings.

2. Prior Art

In many situations, such as camping and other outdoor activities, it is desirable or necessary to have heat, such as a fire. The fire is used to keep warm, provide light, and cook food. Traditionally, fuel for the fire was obtained by gathering dead wood from the surrounding area. Over time, many organized campgrounds have been depleted of readily available, dead wood, and surrounding trees were cut down to fulfill the need for firewood. In response, many campgrounds have implemented rules against destroying vegetation, and requiring campers to provide and carry in their own firewood.

In addition, some wilderness areas are designated as primitive areas, and cutting wood in such areas is prohibited. Other campgrounds are located in deserts, or other areas where firewood is not available. Therefore, it has become necessary in many camping situations to find a source of firewood, and to haul this wood to the campground, or camping area.

Other outdoor activities, besides camping, may require a heat source. For example, many ice fisherman desire a fire to keep warm while fishing on a frozen lake. Again, it is often difficult to find wood because of the snow, and such wood must be hauled to the fishing spot. Therefore, in many types of outdoor activities, either finding wood fuel or transporting wood fuel is difficult and inconvenient. In addition, it is difficult to control the amount of heat produced or the rate of burning. For example, once the fire is started, it is difficult to put it out.

Besides outdoor activities, other situations require a heat source. For example, in emergency situations, such as earthquakes and floods, everyday utility service, such as electricity and natural gas, may be suspended. Depending on the disaster, traditional fuels, such as gas or even wood, may not be available.

Many types of portable heating devices and cooking stoves have been developed for camping and hiking. Many of these devices utilize a liquid fuel, such as propane or white gas, which is contained in small compressed cylinders or small containers. These devices usually fold together for storage and fold open for use. One disadvantage of these devices is that they are typically unstable and loose because of their dynamic movement and compact nature. Another disadvantage with these devices is that the small fuel cylinders or containers typically hold only a limited amount of fuel, and thus cannot operate for extended periods of time. Another disadvantage with these devices is the time and trouble required to assemble the device and connect the fuel source. In addition, these devices are relatively expensive.

In addition to the specialized hiking and camping stoves,. smaller barbeque devices also have been developed. These devices are usually only a smaller version of the larger barbeque, and burn the same briquettes. One disadvantage with these devices is that the briquettes require significant time to ignite and provide heat. Another disadvantage with these device is the need for additional equipment, such as briquette lighters, or additional materials, such as lighter fluid. Another disadvantage with these devices is the lack of control. Once the briquettes are burning, it is difficult to adjust the amount of heat provided or the rate of the burning. For example, once the briquettes are burning, it is difficult to stop them from burning. In addition, briquettes may be rendered useless by moisture.

Therefore, it would be advantageous to develop a heating apparatus for use in camping and other outdoor activities, as well as in emergency situations. It would also be advantageous to develop such a heating apparatus that is portable and self-contained. It would also be advantageous to develop such a heating apparatus that provides heat for extended periods of time. It would also be advantageous to develop such a heating apparatus that is easy to control.

OBJECTS AND SUMMARY OF THE INVENTION

It is an object of the present invention to provide a heating apparatus for camping and other outdoor activities, and for emergency situations.

It is another object of the present invention to provide such a heating apparatus that is portable and self-contained.

It is yet another object of the present invention to provide such a heating apparatus which can provide heat for a prolonged time period.

It is yet another object of the present invention to provide such a heating apparatus which allows the burn time to be controlled.

It is yet another objective of the present invention to provide such a heating apparatus which is resistant to moisture and the elements.

These and other objects and advantages of the present invention are realized in a portable, self-contained heating apparatus having a container with fuel means for burning and producing heat. The fuel means includes a plurality of vertically oriented passages formed therein, and formed between the fuel means and the container wall, for providing flow of air.

The container has an open upper end defining an exhaust opening, a closed lower end, and a container wall defining a cavity. The container wall also defines a first plurality of vent openings through the container wall. Preferably, the first vent openings are at a location closer to the lower end of the container than to the upper end.

In accordance with one aspect of the present invention, the fuel means comprises a plurality of elongated combustible objects. Preferably, the combustible objects are elongated wood sticks. The sticks are disposed in the cavity and tightly compacted together. The plurality of elongated wood sticks are disposed in a vertical orientation in the cavity. The elongated wood sticks substantially fill the cavity and are generally compacted together. The wood sticks include (i) a number of wood sticks contacting adjacent sticks defining adjacent contacting sticks, and (ii) a number of wood sticks spaced apart from adjacent sticks defining spaced-apart sticks. In addition, the wood sticks have (i) unexposed lateral surfaces abutting adjacent contacting sticks, and (ii) exposed lateral surfaces facing opposing spaced-apart sticks. The heat means also comprises a wax material. Preferably, the wax material coats at least a portion of a substantial number of the exposed surfaces of the wood sticks without totally filling all of the vertical passages or the cavity.

In accordance with another aspect of the present invention, the sticks in the cavity of the container define (i) a center zone about a longitudinal axis, and (ii) a perimeter zone between the center zone and the container wall. The wax material coats a substantial portion of substantially all the exposed surfaces of the elongated wood sticks in the center zone, and fills at least some of the vertical passages in the center zone. In addition, the wax material coats a smaller portion of some of the elongated wood sticks in the perimeter zone.

In accordance with another aspect of the present invention, the container wall defines a second plurality of vent openings through the container wall at a location closer to the upper end than to the lower end.

In accordance with another aspect of the present invention, the heating apparatus has means for selectively opening and closing the plurality of vent openings. Preferably, the means for selectively opening and closing comprises an annular band movably disposed on the container. The band moves between (i) a first location in which the annular band is disposed over the plurality of vent openings defining a closed unvented position, and (ii) a second location in which the annular band is disposed away from the plurality of vent openings defining an open vented position.

In accordance with another aspect of the present invention, a lid is removably disposed on the upper end over the exhaust opening for covering the cavity and enclosing the container. In addition, a handle is coupled to the container for carrying the container.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
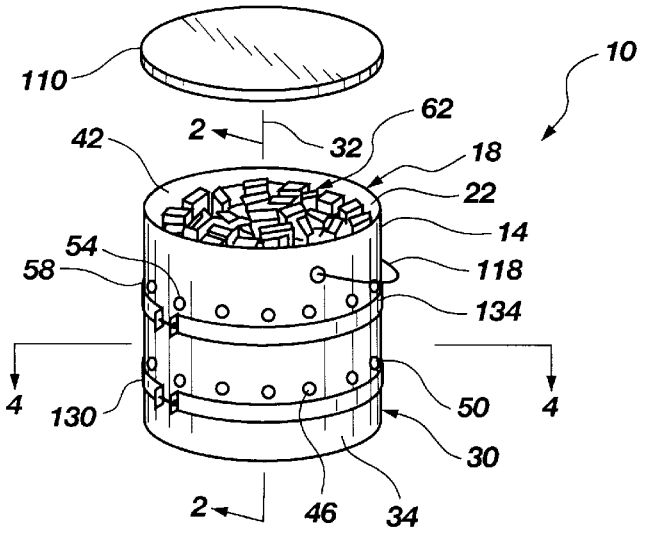
FIG. 1 is a perspective view of a preferred embodiment of a heating apparatus of the present invention.

As illustrated in FIG. 1, a portable, self-contained heating apparatus, indicated generally at 10, for providing heat for extended periods is shown. The heating apparatus 10 has a container 14, such as a bucket. Preferably, the container 14 is generally cylindrical and has a circular cross section, although the container may be any shape. In addition, the container 14 is made of a non-combustible material, such as metal. The container 14 may be any desired size. For example, the container 14 may be a 1 gallon, 3½ gallon, 5 gallon, or 6½ gallon bucket.

The container 14 has an open upper end, indicated generally at 18, which defines an exhaust opening 22. The container 14 also has a closed lower end, indicated generally at 30. The container 14 has a height measured between the upper and lower ends 18 and 30. The container also has a longitudinal axis 32.

The container 14 has a container wall 34 preferably formed into a cylinder with an annular cross section. The container 14 wall 34 also includes a bottom wall 38 (FIG. 2) enclosing the bottom of the container 14. The container wall 34 defines a cavity 42.

The container wall 34 advantageously defines a first plurality of vent openings 46 through the container wall 34. The vent openings 46 preferably are formed in a first row 50, or a straight line around a perimeter of the container 14. The first row 50, or first plurality of openings 46, is located near the lower end 30 of the container 14, or closer to the lower end 30 of the container than the upper end 18.

In addition, the container wall 34 advantageously defines a second plurality of vent openings 54 through the container wall 34. The vent openings 54 preferably are formed in a second row 58. The second row 58, or second plurality of openings 54, is located near the upper end 18 of the container 14, or closer to the upper end 18 than the lower end 30.

Figure 2:
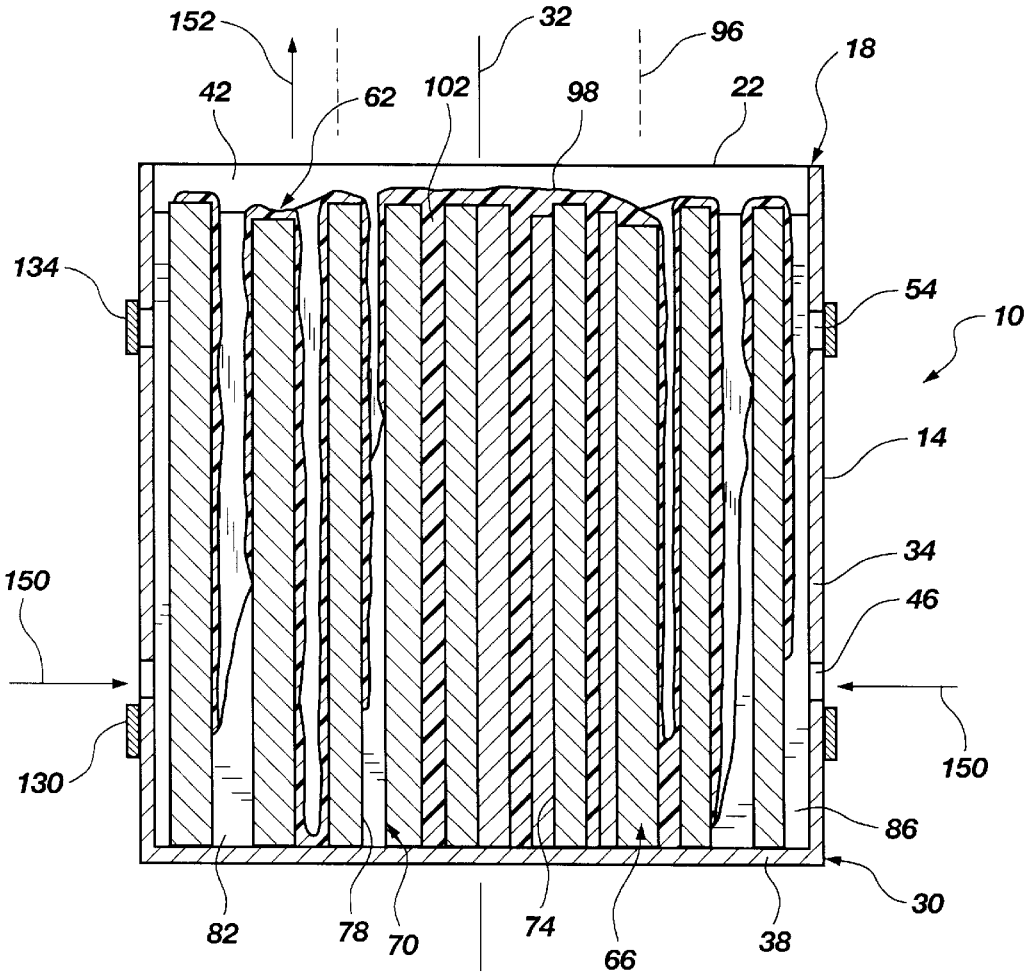
FIG. 2 is a cross sectional side view of the preferred embodiment of the heating apparatus of the present invention taken along line 2—2 of FIG. 1.
Figure 3:
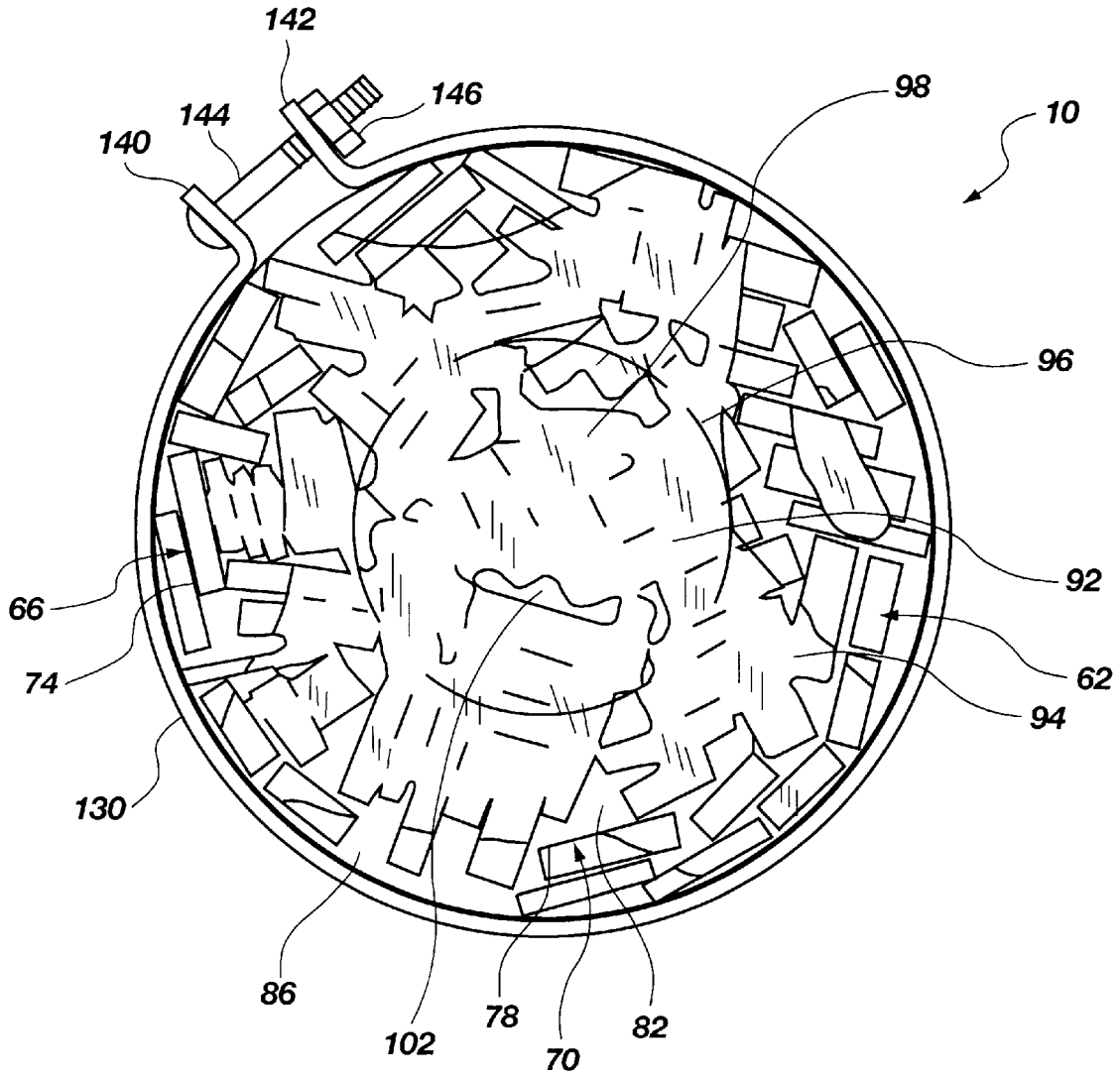
FIG. 3 is a top view of the preferred embodiment of the heating apparatus of the present invention.
Figure 4:
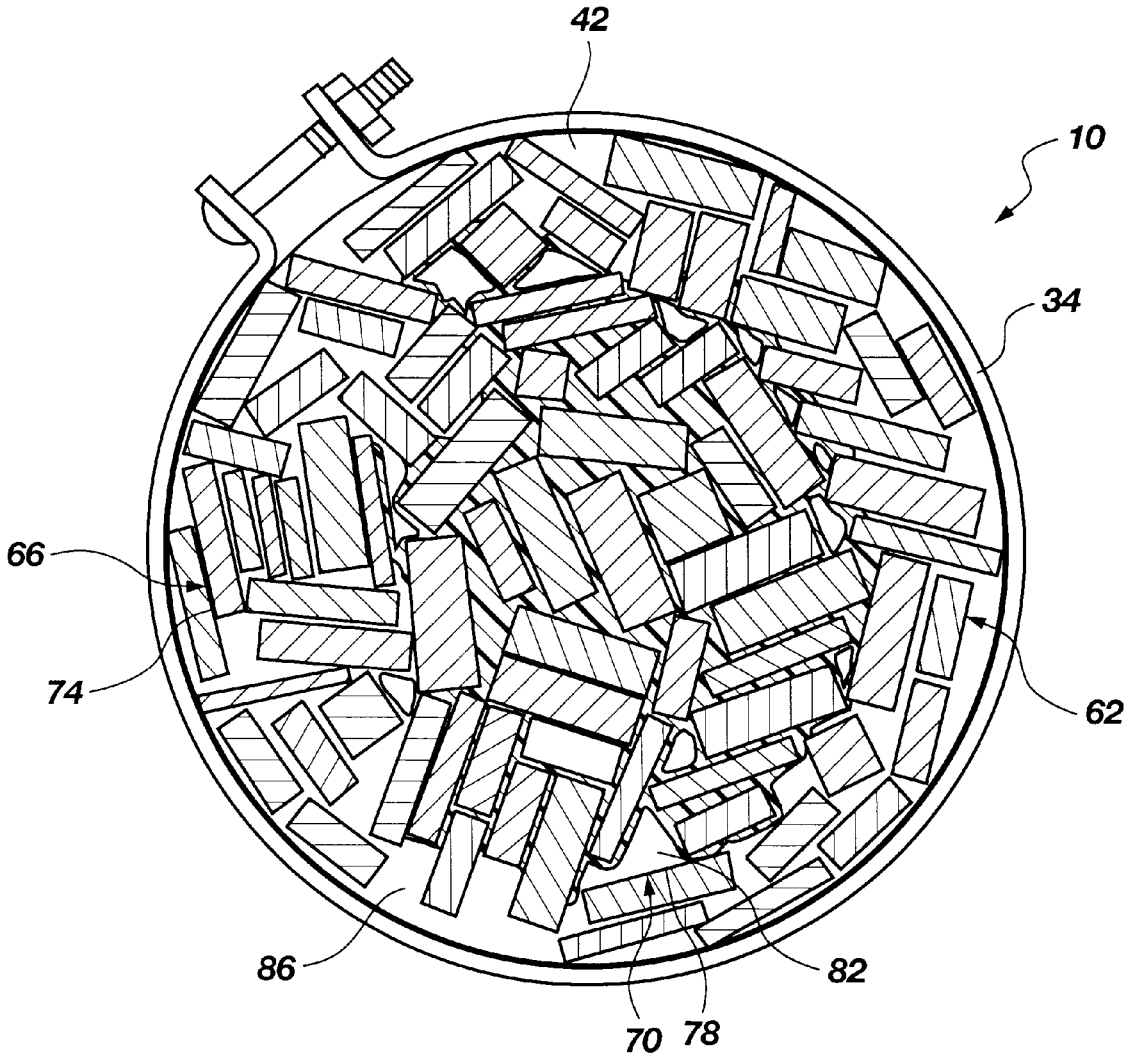
FIG. 4 is a cross sectional top view of the preferred embodiment of the heating apparatus of the present invention taken along line 4—4 of FIG. 1.

The container 14 is filled with a plurality of elongated combustible objects, indicated generally at 62. Preferably, the combustible objects 62 are wood sticks, and most preferably are hardwood sticks. The elongated wood sticks 62 may have various lengths or heights, as shown in FIG. 2, but are preferably substantially equal the height of the container 14, or extend substantially from the lower end 30 of the container 14 to the upper end 18. In addition, the wood sticks 62 may have various different cross-sectional sizes and shapes, as shown in FIGS. 3 and 4. The sticks 62 may be randomly oriented, as shown, or disposed in a pattern.

Referring to FIGS. 2 and 4, the elongated wood sticks 62 are disposed in a vertical orientation in the cavity 42. The wood sticks 62 preferably are compacted together and substantially fill the cavity 42. The plurality of elongated wood sticks 62 include a number or plurality of wood sticks contacting adjacent wood sticks in a contacting relationship and defining adjacent contacting sticks, indicated generally at 66. The plurality of elongated wood sticks 62 include a number or plurality of wood sticks spaced apart from adjacent sticks and define spaced-apart sticks, indicated generally at 70. It is of course understood that some or most sticks 62 may be both adjacent contacting sticks 66 and spaced-apart sticks 70. For example, a stick may be in a contacting relationship with one adjacent stick while spaced apart from another adjacent stick.

The wood sticks 62 have a plurality of lateral surfaces including unexposed lateral surfaces 74 which abut adjacent contacting sticks 66. In addition, the plurality of lateral surfaces includes exposed lateral surfaces 78 which face opposing spaced-apart sticks 70.

The elongated wood sticks 62 advantageously define a first plurality of vertical passages 82 between them for providing an air flow, as discussed more fully below. The passages 82 extend along the length of the wood sticks 62 and generally from the lower end 30 of the container 14 to the upper end 18. In addition, the wood sticks 62 and container wall 34 advantageously define a second plurality of vertical passages 86 between the sticks and the wall. The passages 86 extend between the vent openings 46 and 54 and the exhaust opening 22. Many of the second plurality of passages 86 are in contact or communication with the first plurality of passages 82 such that many of the passages 82 and 86 are in communication with one another and define radial or lateral passages from the vent openings 46 and 54 to the first passages 82.

Referring to FIG. 3, the wood sticks 62 in the cavity 42 of the container 14 define a center zone 92 about the longitudinal axis 32, and a perimeter zone 94 between the center zone and the container wall. The boundary between the two zones 92 and 94 is indicated generally by the dashed line at 96. It is of course understood that the size and shape of the zones 92 and 94 may vary.

Referring to FIGS. 2 and 3, the heating apparatus 10 has a wax material 98 coating at least a portion of a substantial number of the exposed surfaces 78 of the wood sticks 62. Advantageously, the wax material 98 does not, however, fill all the vertical passages 82 or the cavity 42 of the container 14. Thus, the wax material 98 does not block all of the passages 82 or the vent openings 46 and 54. The wax material 98 preferably coats most of the sticks 62, or most of the exposed surfaces 78, although some sticks and some exposed surfaces may not be coated, or may be only partially coated.

More preferably, the wax material 98 substantially coats a substantial portion of substantially all the exposed surfaces 78 of the wood sticks 62 in the center zone 92, and fills at least some of the vertical passages in the center zone 92, indicated at 102. Thus, the center zone 92 is substantially solid and formed of wood sticks 62 and wax material 98. In addition, the wax material 98 coats a smaller portion of some of the elongated wood sticks in the perimeter zone 94.

The wax material 98 preferably is a petroleum based wax and preferably is a blend of yellow bottom and HGVO. The wax material 98 and wood sticks 62 form a combination which preferably is comprised of 80% wood sticks and 20% wax material.

The elongated hardwood sticks 62 and wax material 98 are one example of fuel means for burning and producing heat. Other means for burning and producing heat also may be used, including for example, shorter lengths of wood sticks oriented vertically or at angles, other compositions of wax, different types of wood, other combustible objects, combinations of sawdust and wax, etc.

Referring again to FIG. 1, the heating apparatus 10 preferably has a lid 110 which is removably disposed on the upper end 18 of the container 14 over the exhaust opening 22. The lid 110 covers the cavity 42, including the wood sticks 62 and wax material 98, and encloses the container 14. Preferably, the lid 110 seals against the upper end 18 of the container 14 to protect the wood sticks 98 from moisture. A space is formed between the upper end of the sticks 62 and the upper end 18 of the container 14, and thus the lid 110, as shown in FIG. 2. Thus, additional items (not shown), such as matches, fire starters, and/or kindling, may be included with the apparatus 10 and stored in the container 14. The lid 110 also protect the additional items from moisture. In addition, the apparatus 10 also has a handle 118 coupled to the container 14 to facilitate carrying and transporting the apparatus 10. The handle 118 is pivotally coupled to the container 14 so that it may be pivoted away from the exhaust opening 22, as shown.

Preferably, the heating apparatus 10 advantageously has first and/or second annular bands 130 and 134 movably disposed on the container 14 to selectively open and close the vent openings 130 and 134. The bands 130 and 134 preferably are metal loops, or rings of metal strips, wrapped around the container 14, or the container wall 34. Referring to FIG. 3, the bands, represented by the first band 130, may have first and second ends 140 and 142 bent away from the container wall 34 to extend away from the container 14. Each end 140 and 142 may have a hole (not shown) formed therein for receiving a bolt 144 therethrough. A nut 146 is threadedly secured to the bolt 144 and together they secure the ends 140 and 142 of the bands 130 together.

The bolt and nut 144 and 146 allow the bands 130 to be expanded and contracted, thus allowing the bands 130 to be tightened about or loosened from the container wall 34. Tightening the nut 146 on the bolt 144 brings the ends 140 and 142 closer together, tightens the bands 130 on the container wall 34, and secures the bands 130 to the container 14. Loosening the nut 146 on the bolt 144 allows the ends 140 and 142 to move apart, loosening the bans 130 on the container wall 34, and releasing the bands from the container 14. In addition, the nut and bolt allow the bands to be removed from the container. Thus, the bands may be removably attached to the container.

Preferably, the bands 130 and 134 slide on the container 14 or container wall 34 along the length thereof. Referring to FIG. 2, the bands 130 and 134 move between first and second locations. In the first location, the second band 134 is disposed over the second plurality of vent openings 54 in the container wall 34, thus defining a closed, unvented position. The first band 130 may similarly be disposed over the first plurality of vent openings 46. In the second location, the first band 130 is disposed away from the first plurality of vent openings 46, thus defining an open, vented position. The second band 134 may similarly be disposed away from the second plurality of vent openings 54. The bands 130 and 134 preferably seal against the container wall 34 around the vent openings 46 and 54 in the closed, unvented position. The bands 130 and 134 also protect the wood sticks 62 from moisture.

The annular bands 130 and 134 are one example of means for selectively opening and closing the plurality of vent openings 46 and 54. Other means for selectively opening and closing the vent openings may be used, including for example, closed annular strips which slide up and down on the container wall, strips of non-combustible material adhered to the container wall over the vent openings which may be pulled away, individual doors covering individual vent openings, etc.

In operation, the heating apparatus 10 is usually enclosed and sealed. The lid 110 is disposed on the container 14 and the bands 130 and 134 are disposed over the vent openings 46 and 54. Thus, the apparatus 10 may be stored for long periods of time and resists deteriorating due to moisture and the elements. The handle 118 pivots out of the way so that several apparatuses may be stacked on top of one another. The apparatus 10 may be stored in the basement or garage in case of emergency, or until needed. The handle 118 also allows the apparatus 10 to be easily transported between storage and a vehicle, and from a vehicle to a campsite.

To start the apparatus 10, the handle 118 is pivoted out of the way, and the lid 110 is removed. As indicated above, items (not shown) such as matches, fire starters, and kindling may be stored in the container 14. A fire starter (not shown) may be placed on top of the plurality of wood sticks 62 and wax material 98 generally in the center zone 92 and ignited with a match (not shown), as is well known in the art. Additional wood sticks coated in wax may also be provided as kindling, and which may be placed over the fire starter.

The first starter causes the wood sticks 62 to begin burning and producing heat. The wax material 98 prevents the wood sticks 62 from burning too rapidly, or slows the rate of burning. Experience has shown that the wood sticks 62 will burn to generally a certain level in the container near the upper end 18 and then begin to die out. The second plurality of vent openings 54 preferably is located generally near this level such that the wood sticks 62 burn to a level generally at the location of the second vent openings 54. By leaving the first and second vent openings 46 and 54 closed, or by leaving the bands 130 and 134 disposed over the openings 46 and 54, the wood sticks 62 tend to burn to a certain level and cease burning. Therefore, by leaving the vent openings 46 and 54 closed, the wood sticks 62 may be limited to only partially burning, and the burn time of the apparatus 10 controlled to a relatively short time.

Alternatively, the second vent openings 54 may be opened by removing or sliding the second band 134. It has been found that the plurality of wood sticks 62 will burn to generally a second level in the container near the lower end 30 with the second vent openings 54 open. The first plurality of vent openings 46 preferably is located generally near this level such that the wood sticks 62 burn to the second level generally at the location of the first vent openings 46. By opening the second vent openings 54, but leaving the first vent opening 46 closed, the wood sticks 62 tend to burn to a certain lower level and cease burning. Therefore, by opening the second vent openings 54 and leaving the first vent openings 46 closed, the wood sticks 62 may be limited to only partially burning, and the burn time of the apparatus 10 controlled to a relatively longer time.

In each of the above situations, the apparatus 10 may be used again because the wood sticks 62 have not been fully burned. Thus, the lid 110 may be replaced and the apparatus 10 saved until needed again. In addition, the lid 110 may be placed over the exhaust opening 42, and the vent openings 46 and 54 closed, at any time to extinguish the flames and prevent the sticks 62 from further burning.

Having one or both of the first and second vent openings 46 and 54 closed tends to cause the wood sticks 62 to burn longer, and increase the useful life of the apparatus 10. The apparatus 10 or sticks 62 produce less heat with the vent openings 46 and 54 closed.

For a shorter burn time, and increased heat, both first and second vent openings 46 and 54 may be opened, or both bands 130 and 134 moved. It has been founded that the sticks 62 burn faster and produce more heat with the vent openings 46 and 54 open.

When the vent openings 46 and 54 are open, air is allowed to flow into the cavity 42 of the container 14 to help fuel the combustion of the sticks 62, as indicated by arrows 150 (FIG. 2). The heat produced by the burning of the sticks 62 causes exhaust gases to rise through the exhaust opening 22, indicated by arrow 152. The rise of exhaust gases causes a draft or vacuum which draws air through the openings 46 and 54, indicated at 150. The air enters through the openings 46 and 54 and passes through the vertical passages 82 and 86 along the length of the sticks 62. Thus, the plurality of passages 82 and 86 allow for air to flow around the burning sticks 62. Because the wax material 98 substantially coats the sticks 62 without filling many of the passages 82 and 86, the burning sticks 62 receive air to burn while the wax prevents the sticks from burning too quickly.

In addition, the center zone 92 which is substantially full of wax material 98 creates a solid core which burns more slowly, while the perimeter zone which is more open allows air flow.

Figure 5:
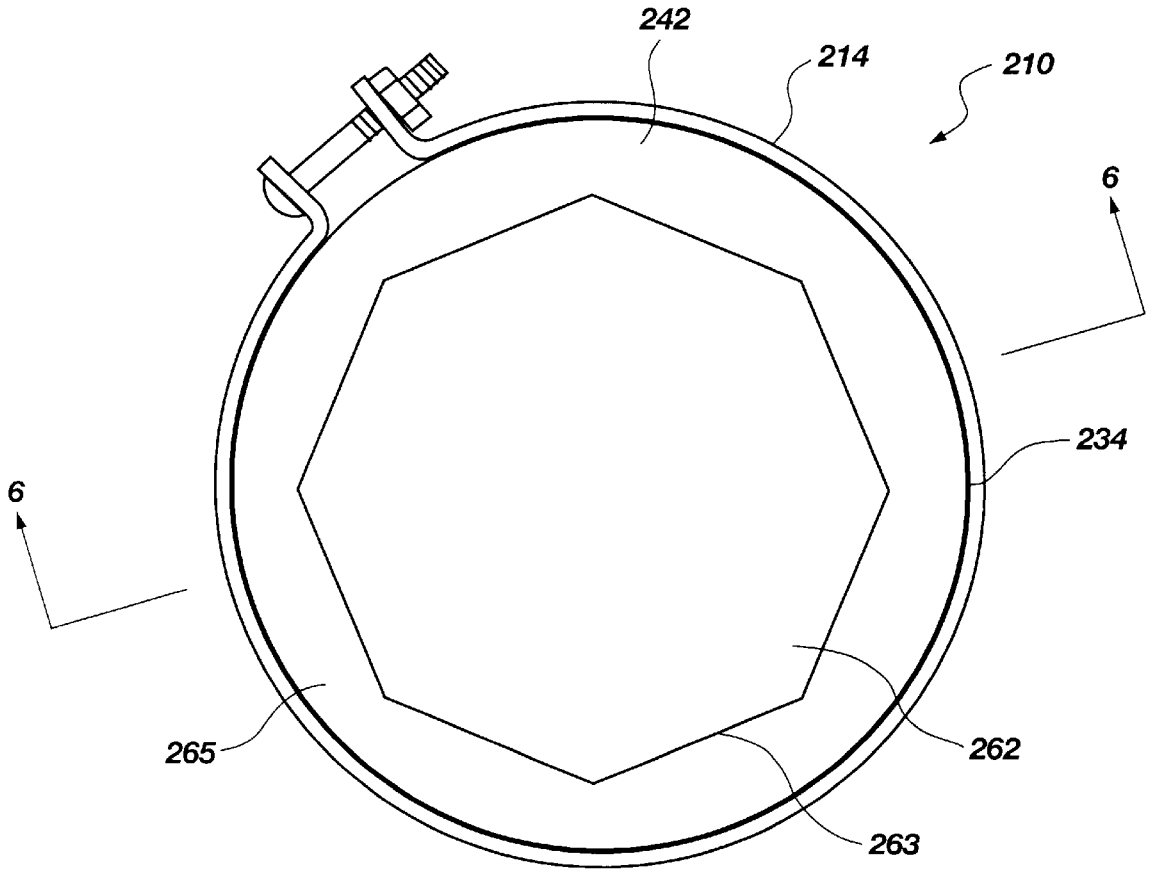
FIG. 5 is a top view of an alternative embodiment of a heating apparatus of the present invention.
Figure 6:
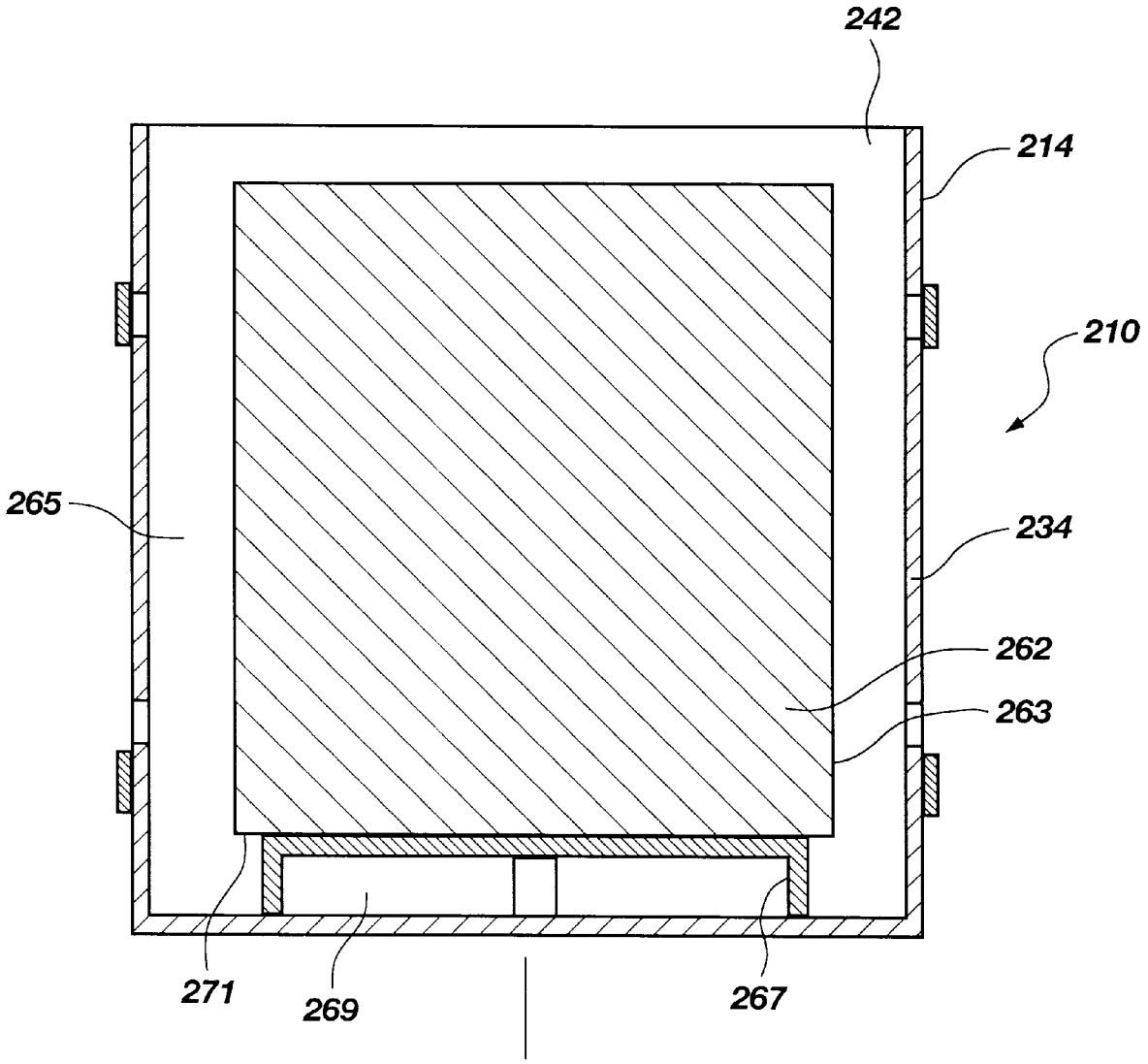
FIG. 6 is a cross sectional side view of the alternative embodiment of the heating apparatus of the present invention taken along line 6—6 of FIG. 5.

Referring to FIGS. 5 and 6, an alternative embodiment of a heating apparatus, indicated generally at 210, is shown. The alternative embodiment of the heating apparatus 210 is similar in many respects to the preferred embodiment of the heating apparatus 10 described above. The heating apparatus 210 has a container 214 with a container wall 234 defining a cavity 242. The heating apparatus 210 also has a block 262 formed of sawdust and wax disposed in the cavity 242. The block 262 may be of any shape, but is preferably elongated with an octagonal cross section, as shown in FIG. 5. In addition, the block 262 may be solid, as shown, or may have a plurality of passages 82 (FIGS. 2–4) formed therein, as described above with respect to the preferred embodiment. The block 262 has a perimeter surface or side 263. An air passage 265 is defined between the perimeter surface 263 of the block 262 and the container wall 234. The air passage 265 allows air to flow around the block 262 and facilitates combustion of the block 265. The block 262 is preferably sized smaller than the cavity 242 and the perimeter surface 263 of the block 262 does not contact the container wall 234. Thus, the passage 265 is annular and extends completely, or substantially, around the block 262. It has been found that combustion of the block 262 is facilitated by the passage 265 formed around the block 262. The block 262 of sawdust and wax is another example of fuel means.

Referring to FIG. 6, the heating apparatus 210 also may have a stand 267 disposed in the cavity 242 of the container 240 and under the block 262 to position the block 262 above the bottom wall 238 of the container 240. Thus, a space 269 is formed between the bottom wall 238 of the container 240 and a bottom 271 of the block 262. It has been found that combustion of the block is facilitated by the space 269.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A portable, self-contained heating apparatus comprising:

a container having an open upper end defining an exhaust opening, a closed lower end, and a container wall defining a cavity;

a first plurality of vent openings formed through the container wall at a location closer to the lower end of the container than to the upper end;

a plurality of elongated, solid, combustible objects disposed in a vertical orientation in the cavity for burning and producing heat, the plurality of elongated combustible objects substantially filling the cavity and being generally compacted together with a plurality of adjacent combustible objects in a contacting relationship, the plurality of elongated combustible objects having a plurality of exposed surfaces;

a first plurality of vertical passages formed between the plurality of elongated combustible objects for providing flow of air, the first plurality of vertical passages extending along the length of the elongated combustible objects;

a second plurality of vertical passages formed between the plurality of elongated combustible objects and the container wall and extending between the vent openings and the exhaust opening for providing flow of air; and a wax material coating at least a portion of the plurality of exposed surfaces of the plurality of elongated combustible objects without totally filling all of the first or second plurality of vertical passages or the cavity.

2. The heating apparatus of claim 1, further comprising:

means for selectively opening and closing the plurality of vent openings.

3. The heating apparatus of claim 1, further comprising:

an annular band movably disposed on the container between (i) a first location in which the annular band is disposed over the plurality of vent openings defining a closed unvented position, and (ii) a second location in which the annular band is disposed away from the plurality of vent openings defining an open vented position.

4. The heating apparatus of claim 1, wherein the container wall defines a second plurality of vent openings through the container wall at a location closer to the upper end than to the lower end; and further comprising means for selectively opening and closing the second plurality of vent openings.

5. The heating apparatus of claim 1, wherein the plurality of combustible objects comprises hardwood sticks.

6. The heating apparatus of claim 1, wherein the wax material is a petroleum based wax blend of yellow bottom and HGVO.

7. The heating apparatus of claim 1, wherein the plurality of combustible objects and wax material form a combination with 80% combustible objects and 20% wax material.

8. The heating apparatus of claim 1, further comprising:

a lid removably disposed on the upper end over the exhaust opening for covering the cavity and enclosing the container; and a handle coupled to the container for carrying the container.

9. A portable, self-contained heating apparatus comprising:

a container having an open upper end defining an exhaust opening, a closed lower end, a longitudinal axis and a first plurality of vent openings formed through the container wall at a location closer to the lower end than to the upper end;

a plurality of elongated wood sticks disposed in a vertical orientation in the cavity for burning and producing heat, the elongated wood sticks substantially filling the cavity and being generally compacted together, the plurality of elongated wood sticks including (i) a number of wood sticks contacting adjacent sticks defining adjacent contacting sticks, and (ii) a number of wood sticks spaced apart from adjacent sticks defining spaced-apart sticks;

the plurality of wood sticks having:

(i) unexposed lateral surfaces abutting adjacent contacting sticks, and (ii) exposed lateral surfaces facing opposing spaced-apart sticks;

the plurality of elongated sticks defining a plurality of vertical passages therebetween, the passages extending along the length of the elongated sticks for providing flow of air;

the plurality of elongated sticks and the container wall defining another plurality of vertical passages between the sticks and the wall and extending between the vent openings and the exhaust opening for providing flow of air; and a wax material coating at least a portion of a substantial number of the exposed surfaces of the plurality of elongated wood sticks without totally filling all of the vertical passages or the cavity;

the plurality of wood sticks and wax in the cavity of the container defining:

(i) a center zone about the longitudinal axis in which the wax material coats a substantial portion of substantially all the exposed surfaces of the elongated wood sticks in the center zone, and fills at least some of the vertical passages in the center zone; and (ii) a perimeter zone between the center zone and the container wall in which the wax material coats a smaller portion of some of the elongated wood sticks in the perimeter zone.

10. The heating apparatus of claim 9, wherein the plurality of elongated wood sticks disposed in the cavity of the container have a height extending from the lower end of the container substantially to the upper end of the container.

11. The heating apparatus of claim 9, wherein the plurality of combustible objects comprises hardwood sticks; and wherein the wax material is a petroleum based wax blend of yellow bottom and HGVO.

12. The heating apparatus of claim 9, wherein the container wall defines a second plurality of vent openings through the container wall at a location closer to the upper end than to the lower end; and further comprising means for selectively opening and closing the second plurality of vent openings.

13. The heating apparatus of claim 1, wherein the plurality of elongated objects fill a majority of the cavity.

14. The heating apparatus of claim 1, wherein the container has a longitudinal axis; wherein the plurality of elongated combustible objects in the cavity of the container define:

(i) a center zone about the longitudinal axis, the wax material coating a substantial portion of substantially all the exposed surfaces of the elongated combustible objects in the center zone and filling at least some of the vertical passages in the center zone; and (ii) a perimeter zone between the center zone and the container wall, the wax material coating a smaller portion of some of the elongated combustible objects in the perimeter zone.

15. The heating apparatus of claim 1, further comprising:

an annular band slidably disposed on the container and vertically sliding between (i) a first location over the plurality of vent openings, and (ii) a second location away from the plurality of vent openings.

16. The heating apparatus of claim 9, further comprising:

an annular band slidably disposed on the container and vertically sliding between (i) a first location over the plurality of vent openings, and (ii) a second location away from the plurality of vent openings.

17. The heating apparatus of claim 9, further comprising:

a lid removably disposed on the upper end of the container over the exhaust opening for covering and enclosing the cavity; and a handle coupled to the container for carrying the container.

18. A portable, self-contained heating apparatus, comprising:

a container having a cavity;

a plurality of elongated, solid, combustible objects, disposed in a vertical orientation in the cavity of the container to substantially fill the cavity, having abutting surfaces abutting adjacent elongated, solid, combustible objects, and exposed surfaces creating vertical passages therebetween; and a wax material coating at least a portion of the exposed surfaces of the elongated, solid, combustible objects without totally filling all of the vertical passages or the cavity.

19. The heating apparatus of claim 18, wherein the container has an open upper end defining an exhaust opening and a closed lower end; and wherein the plurality of elongate, solid, combustible objects extend vertically from the lower end of the container to near the upper end of the container.

20. The heating apparatus of claim 18, wherein the container has an open upper end defining an exhaust opening, a lower end and a container wall with a plurality of vent openings near the lower end; and wherein the vertical passages include (i) a first plurality of vertical passages formed between the elongated, solid, combustible objects, and (ii) a second plurality of vertical passages formed between the elongated, solid, combustible objects and the container wall which extend from the vent openings to the exhaust opening.

* * * * *